US009224547B2

(12) United States Patent
Martinez Vite

(10) Patent No.: US 9,224,547 B2
(45) Date of Patent: Dec. 29, 2015

(54) VEHICLE DOOR WINDOW SWITCH

(71) Applicant: GM GLOBAL TECHNOLOGY OPERATIONS LLC, Detroit, MI (US)

(72) Inventor: Hector A. Martinez Vite, Mexico City (MX)

(73) Assignee: GM Global Technology Operations LLC, Detroit, MI (US)

( * ) Notice: Subject to any disclaimer, the term of this patent is extended or adjusted under 35 U.S.C. 154(b) by 170 days.

(21) Appl. No.: 14/089,074

(22) Filed: Nov. 25, 2013

(65) Prior Publication Data

US 2015/0144469 A1 May 28, 2015

(51) Int. Cl.
*H01H 19/06* (2006.01)
*H01H 9/02* (2006.01)

(52) U.S. Cl.
CPC ..... *H01H 9/02* (2013.01); *H01H 2231/026* (2013.01); *H01H 2300/01* (2013.01)

(58) Field of Classification Search
CPC ..... H01H 9/02; H01H 9/04; H01H 13/06; H01H 19/06; H01H 21/08
USPC ..... 200/302.3, 304, 302.1, 302.2, 303
See application file for complete search history.

(56) References Cited

U.S. PATENT DOCUMENTS

| | | | | |
|---|---|---|---|---|
| 5,117,074 | A * | 5/1992 | Yanai et al. | 200/302.3 |
| 6,385,045 | B1 * | 5/2002 | Tissington | 361/704 |
| 2012/0024681 | A1 * | 2/2012 | Kitahara et al. | 200/341 |

* cited by examiner

*Primary Examiner* — Renee Luebke
*Assistant Examiner* — Lheiren Mae A Caroc
(74) *Attorney, Agent, or Firm* — Cantor Colburn LLP

(57) ABSTRACT

A vehicle door switch is provided. The door switch includes a top housing and a bottom housing. The bottom housing having at least one first opening arranged opposite the top housing. A printed circuit board is disposed within the housing. A shield member is provided having a planer portion with a top surface and a bottom surface. The bottom surface is arranged adjacent the printed circuit board, the shield member further having a side wall extending about the perimeter of the planer portion. The printed circuit board is disposed within the area defined by the side wall.

16 Claims, 3 Drawing Sheets

VEHICLE DOOR WINDOW SWITCH

FIELD OF THE INVENTION

The subject invention relates to a switch for a door of a vehicle and, more particularly, to a window switch that shields a printed circuit board from moisture.

BACKGROUND

Electrical switches are used for controlling electrical circuits. Many electrical switches are constructed from a combination of mechanical and electrical components. Such switches translate user input to an electrical control signal. For example, a light switch having an external toggle enables a user to selectively open and close a circuit for turning "on" and "off" a light.

In automotive applications, electrical switches are often used for controlling electro-mechanical systems such as power windows that open and close automobile door windows. These window switches may often be integrated into a console or door frame along with other electrical switches, e.g. power door locks. As the number of electrically controlled components in an automobile increases, the space available for housing these components can become limited.

Electrical components used in an automobile are also prone to contamination due to the nature of activities that may occur during operation of the automobile. For example, a beverage that is spilled or rain water from a door or window being opened may contaminate electrical switches and their accompanying circuitry. It should be appreciated that these contaminates may cause reliability and operating issues for the vehicle operator.

Accordingly, while existing vehicle door switches are suitable for their intended purposes, it is desirable to provide a vehicle door switch that shields its internal electrical circuitry from contaminates such as moisture to improve reliability of the door switch.

SUMMARY OF THE INVENTION

In one exemplary embodiment of the invention a vehicle door switch is provided. The door switch includes a top housing and a bottom housing. The bottom housing having at least one first opening arranged opposite the top housing. A printed circuit board is disposed within the housing. A shield member is provided having a planer portion with a top surface and a bottom surface. The bottom surface is arranged adjacent the printed circuit board, the shield member further having a side wall extending about the perimeter of the planer portion. The printed circuit board is disposed within the area defined by the side wall.

In another exemplary embodiment of the invention another vehicle door switch is provided. The vehicle door switch includes a top housing having a first wall extending about a perimeter. A button member is operably coupled to the top housing. A bottom housing is provided having a second wall extending about a perimeter, the bottom housing being coupled to the top housing to define an interior space, the bottom housing having a plurality of first openings arranged opposite the top housing. A printed circuit board is disposed within the interior space. A shield member is disposed within the interior space between the printed circuit board and the button, the shield member having a side wall extending about a perimeter, the printed circuit board being disposed within an area defined by the side wall. A drain member is sealingly coupled to the shield member, the drain member having a channel disposed about a perimeter adjacent the side wall, the channel having a plurality of second openings substantially aligned with the plurality of first openings.

The above features and advantages and other features and advantages of the invention are readily apparent from the following detailed description of the invention when taken in connection with the accompanying drawings.

BRIEF DESCRIPTION OF THE DRAWINGS

Other features, advantages and details appear, by way of example only, in the following detailed description of embodiments, the detailed description referring to the drawings in which.

DESCRIPTION OF THE EMBODIMENTS

Figure 1:
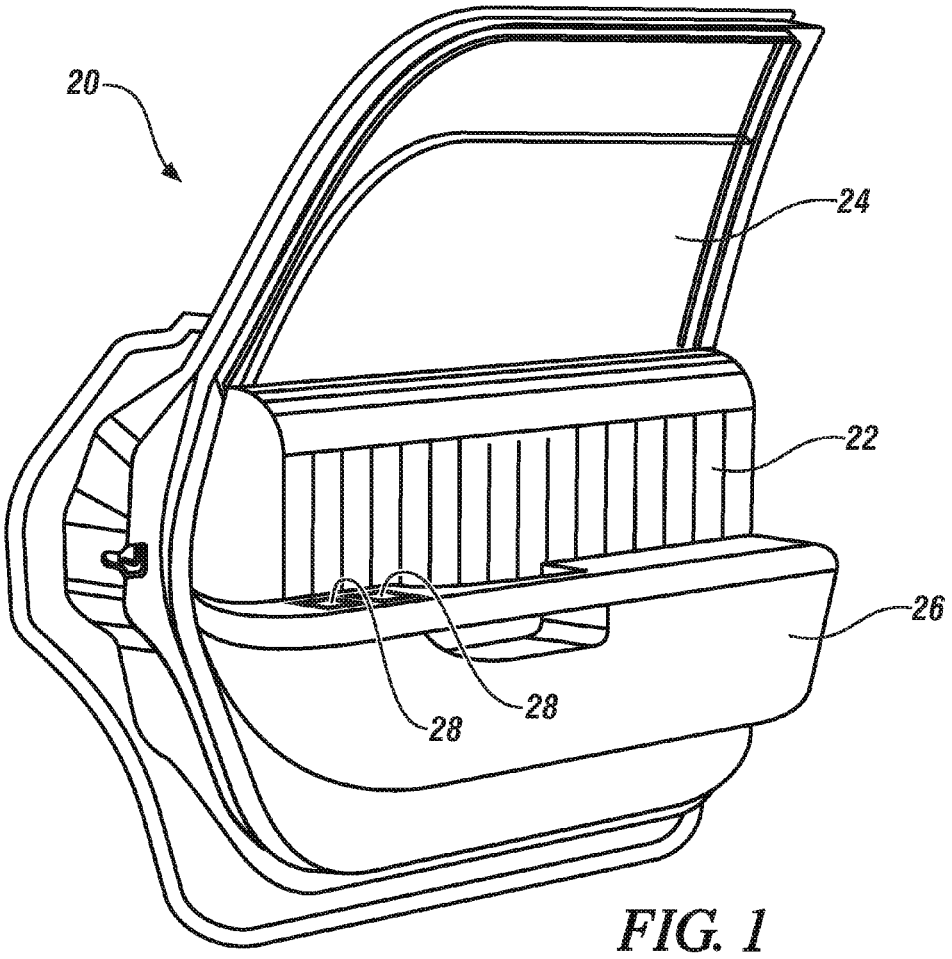
FIG. 1 is a perspective view of an interior panel of a vehicle door in accordance with an embodiment of the invention.

The following description is merely exemplary in nature and is not intended to limit the present disclosure, its application or uses. It should be understood that throughout the drawings, corresponding reference numerals indicate like or corresponding parts and features.

Embodiments of the subject invention provide a switch for use in a vehicle door. The switch provides improved performance and reliability by shielding internal electrical circuits from contaminates such as water or other liquids. Embodiments of the subject invention provide advantages in directing water that migrates into the switch into a drain that facilitates removal of the water from the switch without contacting the internal electrical circuits.

Referring now to FIG. 1, a vehicle door 20 is illustrated. Vehicle doors typically are provided to separate an interior compartment of the vehicle from the external environment. It should be appreciated that during inclement weather, moisture from the environment may come into contact with the interior door panel 22 of the door 20. The door 20 may also include a window 24 that selectively moves between an open and a closed position as desired by the operator. The operator may occasionally need to open the window 24 during inclement weather. Similar to when the door is opened, these situations may result in water entering the vehicle and contacting the door panel 22. The door panel 22 further includes an arm rest 26 having one or more actuators or switches 28. It should be appreciated that the switches 28 may also be arranged on other portions of the interior door panel 22 and the illustrated embodiment is exemplary in nature and not intended to be limiting. Further, while embodiments herein may refer to the contaminate as water, this is for exemplary purposes and not intended to be limiting. Other contaminates may include any liquid, such as but not limited to beverages (e.g. coffee, sofa, etc.), oil, gasoline and cleaning solutions for example.

In one embodiment, the switches 28 allow the vehicle occupant to control one or more functions of the vehicle. The switches 28 may be a window actuator that allows the operator to open and close the window for example. In other embodiments, the switches 28 may provide other functionality, such as lock and unlock the door 20, turn on a vehicle light, allow adjustment of a mirror or control an entertainment system for example. It should be appreciated that while embodiments herein may refer to a window switch, this is for exemplary purposes and not intended to limit the claimed invention.

Figure 2:
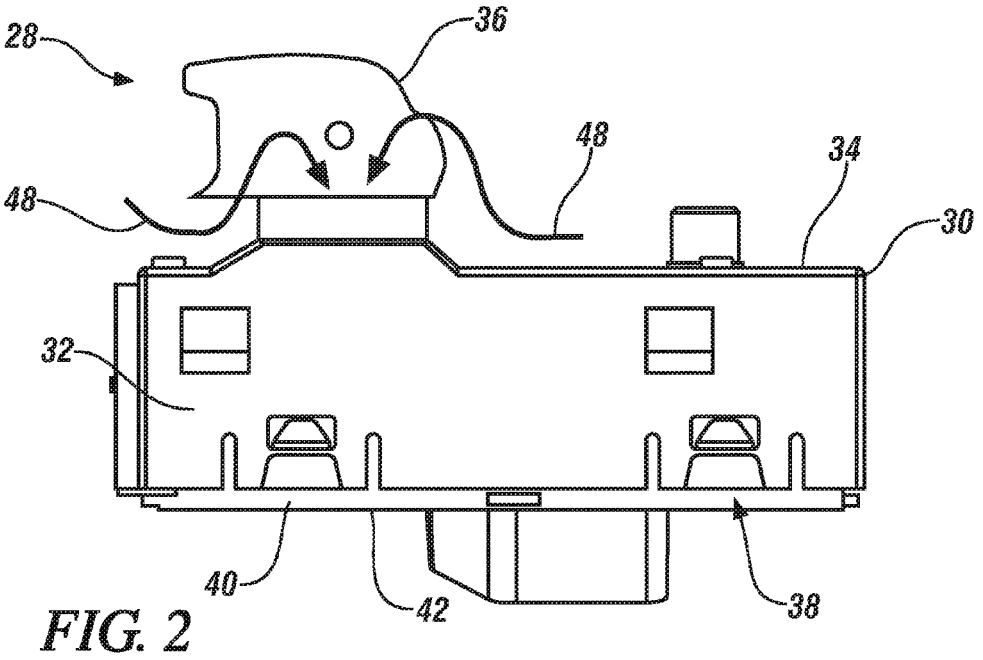
FIG. 2 is a side view of a window switch for use in the door of FIG. 1 in accordance with an embodiment of the invention.

Referring now to FIG. 2, an exemplary switch 28 is shown, such as a window switch for example. The switch 28 includes a top housing 30 having a wall 32 extending about the perimeter of a top surface 34. An actuator or button 36 is disposed on the top surface 34. The button 36 provides an interface that allows the vehicle occupant to interact with the switch 28. It should be appreciated that the button 36 will have one or more features (not shown) that extend through the top housing 30 into an interior space to allow the button 36 to actuate electrical circuits. As a result of this opening, water or other contaminates may migrate into the interior of the switch 28.

Figure 3:
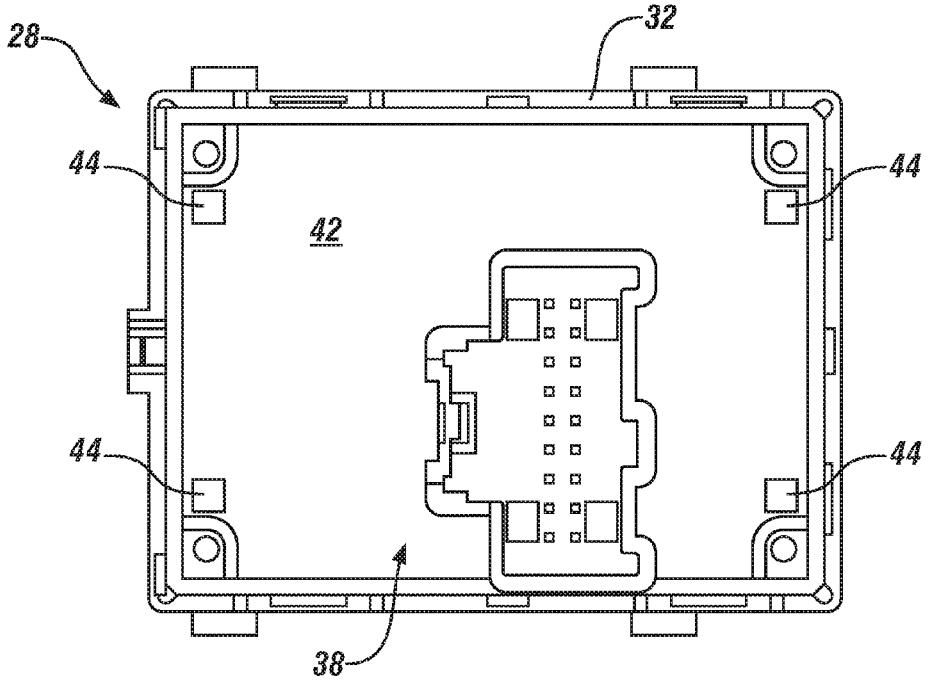
FIG. 3 is a bottom view of the window switch of FIG. 2 in accordance with an embodiment of the invention.

Opposite the top housing 30 is a bottom housing 38. Similar to the top housing 30, the bottom housing 38 includes a wall 40 extending from a bottom surface 42. In the exemplary embodiment, the wall 40 couples to the wall 32, such as with snap-fit features for example. As shown in FIG. 3, the bottom surface 42 may include one or more drain openings 44. As will be discussed in more detail below, the drain openings 44 are arranged to receive liquids that migrate into the interior of the switch 28 via a path shown by arrows 48 (FIG. 2). It should be appreciated that while the illustrated embodiment shows square shaped openings 44, this is for exemplary purposes and the claimed invention should not be so limited. The openings 44 may be of any suitable shape that allows a liquid to be transferred out of the switch 28.

Figure 4:
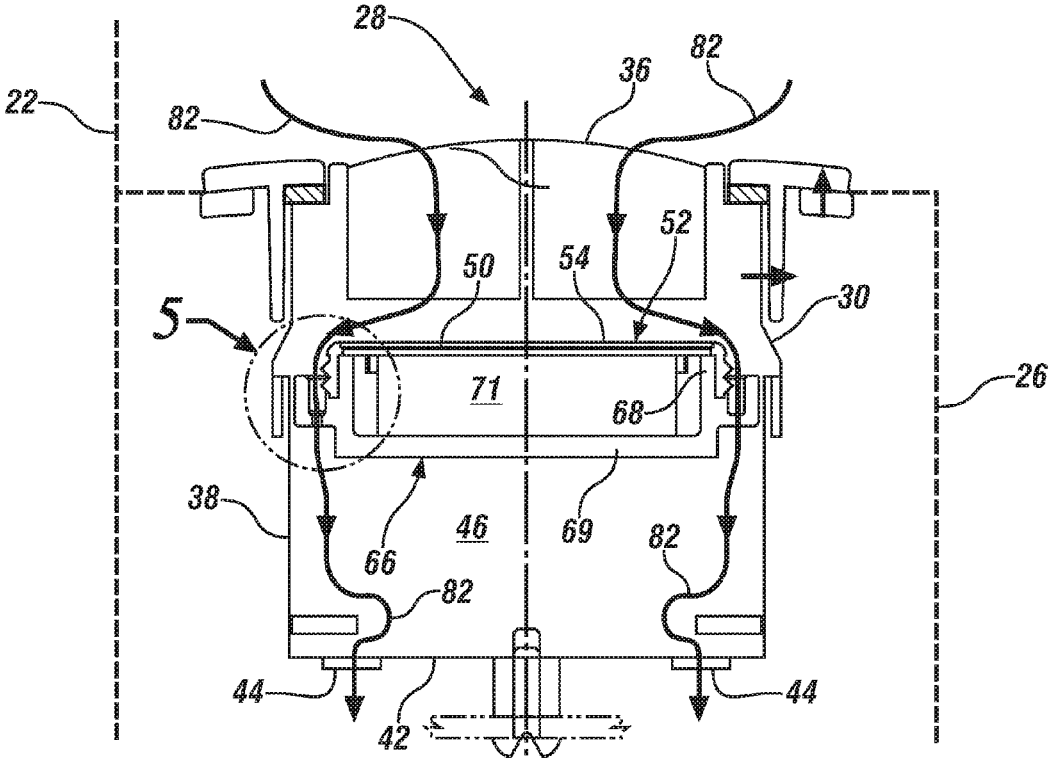
FIG. 4. is a partial side sectional view of the window switch of FIG. 2.
Figure 5:
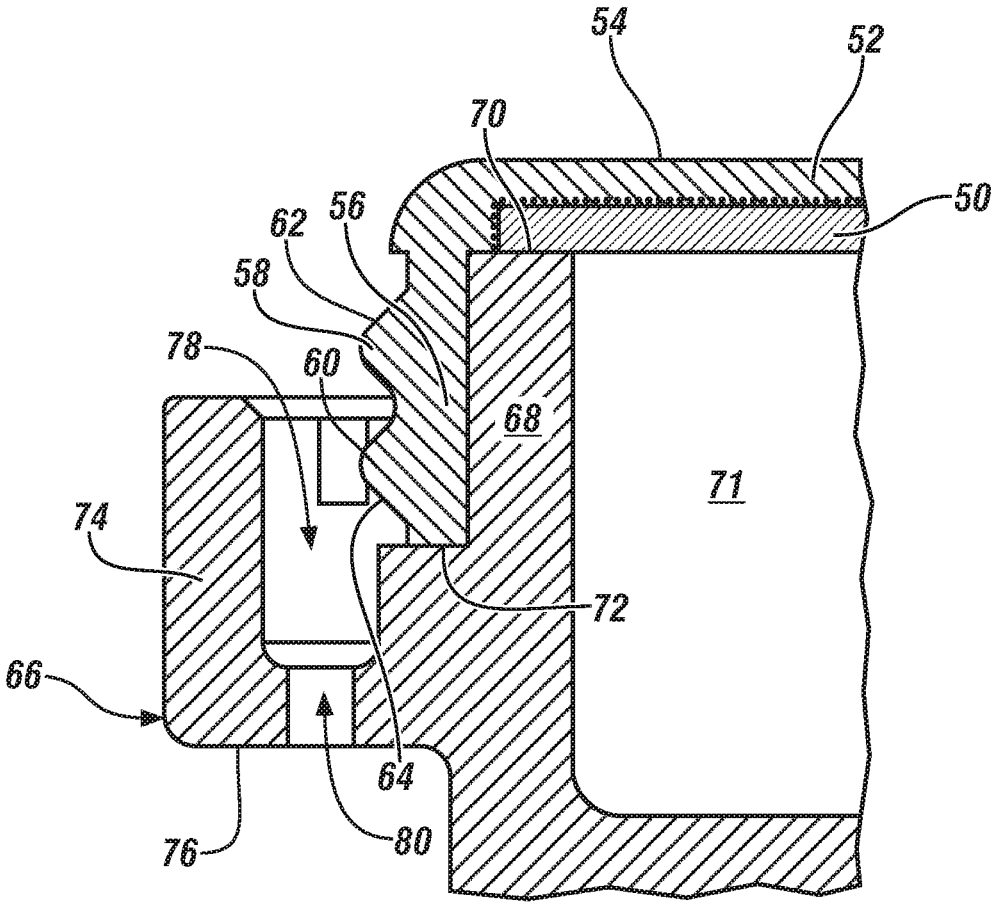
FIG. 5 is an enlarged view of a drain channel and seal portion of the window switch of FIG. 2.

Referring now to FIG. 4 and FIG. 5, the internal components of the switch 28 are shown. Disposed within the interior 46 of the top housing 30 and bottom housing 38 is a printed circuit board 50. The printed circuit board 50 includes electrical circuitry to provide the desired functionality of the switch 28. In the exemplary embodiment, the printed circuit board 50 is a substantially planar member that may have one or more electrical components (e.g. resistors, capacitors) arranged on one or both sides. The button 36 is operably coupled to the printed circuit board 50 via a shield member 52.

In the exemplary embodiment, the shield member 52 is made from an elastomeric material, such as rubber for example, that resists the absorption or transfer of liquids therethrough. The shield member 52 includes a generally planar top surface portion 54. In one embodiment, the top surface portion 54 may be contoured (e.g. sloped) to facilitate the flow of liquid. A side wall 56, FIG. 5, extends about the perimeter of the top surface portion 54 in a direction opposite the button 36. The side wall 56 has a length sufficient to extend past the printed circuit board 50. As such, the printed circuit board 50 may be arranged adjacent the top surface portion 50 and be surrounded on at least three-sides by the shield member 52. In one embodiment, the side wall 56 includes a plurality of ribs 58, 60 that extend outward about the periphery of the side wall 56. In the exemplary embodiment, the ribs 58, 60 include lead-in surfaces 62, 64 that are arranged on a 45 degree angle relative to the top surface portion 54. In one embodiment, the end of the ribs 58, 60 have a radius of 0.1 mm and the surface therebetween has a radius of 0.2 mm.

The shield member 52 is coupled to a drain member 66. The drain member 66 includes an inner wall 68 that extends about a periphery and defines an interior portion 71 (FIG. 4). The inner wall 68 includes an end surface 70 that is sized to receive and support the edge of the printed circuit board 50. In the exemplary embodiment, the printed circuit board 50 is captured between the top surface portion 54 and the end surface 70. The inner wall 68 and side wall 56 are sized to provide a small interference fit that allows the shield member 52 to be coupled to the drain member 66 while also providing a seal that inhibits the migration of water or liquids into the interior portion 71. In one embodiment, the interior portion 71 is further isolated from the interior portion 46 by a wall 69. In one embodiment, the inner wall 68 includes a recess 72 arranged opposite the interior portion 71 that is sized to receive at least the body portion of the side wall 56.

The drain member 66 further includes an outer wall 74 that is connected to the inner wall 68 by a third wall 76. The inner wall 68, outer wall 74 and third wall 76 cooperate to define a generally u-shaped channel 78. The channel 78 includes one or more openings 80 that extend through the third wall 76. In the exemplary embodiment, there are four openings 78 positioned within the channel 78 to align with the openings 44 of the bottom housing 42. The u-shaped channel is sized and positioned to receive liquids flowing from the top surface portion 54 into the openings 80.

In the event that water or another liquid is spilled, sprayed or otherwise transferred onto the door panel 22, the water or liquid could migrate into the switch 28 via a path represented by the arrows 82 (FIG. 4). As water migrates into the interior space 46, the water will contact the top surface portion 54 and flow towards the side wall 56. In one embodiment, the top surface portion 54 may be sloped or contoured to facilitate flow of water toward the side wall 56. As the water flows over the edge of the top surface portion 54, the ribs 58, 60 may assist in breaking the surface tension of the water and facilitate the flow into the channel 78. Once in the channel 78, the water flows out through the openings 80 towards the openings 44 in the bottom housing 42 as represented by the arrows 82. It should be appreciated that the arrangement of the shield member 52 with the drain member 66 inhibits the migration of water or liquids into the interior 71. As a result, printed circuit board 50 and its associated electrical circuits are isolated from the liquids and remain dry, which improves performance and reliability of the switch 28.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiments disclosed, but that the invention will include all embodiments falling within the scope of the application.

What is claimed is:

1. A vehicle door switch comprising a top housing;

a bottom housing having at least one first opening opposite the top housing, the top housing and bottom housing defining an interior space;

a printed circuit board disposed within the interior space; and a shield member having a planer portion with a top surface and a bottom surface, the bottom surface being adjacent the printed circuit board, the shield member further having a side wall extending about the perimeter of the planer portion, the printed circuit board being disposed within the area defined by the side wall, the side wall having plurality of ribs that extend about the perimeter of the side wall.

2. The vehicle door switch of claim 1, further comprising a drain member coupled to the shield member, the drain member having a channel disposed about the perimeter of the drain member adjacent the side wall.

3. The vehicle door switch of claim 2, wherein the drain member includes a first wall extending about a perimeter to define an interior space, the printed circuit board being in contact with an end surface of the first wall.

4. The vehicle door switch of claim 3, wherein the drain member further includes a second wall extending about the perimeter of the drain member and third wall extending between the first wall and the second wall, the first wall, second wall and third wall defining the channel.

5. The vehicle door switch of claim 4, wherein the first wall includes a recess disposed between the first wall and the second wall, the shield member side wall being disposed within the recess.

6. A vehicle door switch comprising:

a top housing;

a bottom housing having at least one first opening opposite the top housing;

a printed circuit board disposed within the housing;

a shield member having a planer portion with a top surface and a bottom surface, the bottom surface being adjacent the printed circuit board, the shield member further having a side wall extending about the perimeter of the planer portion, the printed circuit board being disposed within the area defined by the side wall;

a drain member coupled to the shield member, the drain member having a channel disposed about the perimeter of the drain member adjacent the side wall; and wherein the side wall is disposed within the channel.

7. The vehicle door switch of claim 6, wherein the side wall includes at least one rib.

8. The vehicle door switch of claim 7, wherein the side wall includes a pair of parallel ribs that extend about the perimeter of the side wall.

9. The vehicle door switch of claim 7, wherein the shield member is made from an elastomeric material.

10. The vehicle door switch of claim 7, wherein the drain member includes at least one second opening in a bottom surface of the channel, the at least one second opening being arranged adjacent the at least one first opening.

11. A vehicle door switch comprising:

a top housing having a first wall extending about a perimeter;

a button member operably coupled to the top housing;

a bottom housing having a second wall extending about a perimeter, the bottom housing being coupled to the top housing to define an interior space, the bottom housing having a plurality of first openings arranged opposite the top housing;

a printed circuit board disposed within the interior space;

a shield member disposed within the interior space between the printed circuit board and the button, the shield member having a side wall extending about a perimeter, the printed circuit board being disposed within an area defined by the side wall; and a drain member sealingly coupled to the shield member, the drain member having a channel disposed about a perimeter adjacent the side wall, the channel having a plurality of second openings substantially aligned with the plurality of first openings wherein the shield member side wall extends in a direction opposite the button wherein the side wall further includes at least one rib extending about a perimeter of the side wall.

12. The vehicle door switch of claim 11, wherein the shield member is made from an elastomer.

13. The vehicle door switch of claim 11, wherein the drain member includes an inner wall extending about a perimeter, the inner wall having an end surface in contact with the printed circuit board.

14. The vehicle door switch of claim 13, wherein the drain member includes an outer wall disposed about the perimeter, the channel being defined by the inner wall and outer wall.

15. The vehicle door switch of claim 14, wherein the inner wall includes a recess adjacent the channel, the side wall being disposed within the recess.

16. The vehicle door switch of claim 11 wherein the side wall includes a plurality of ribs extending about a perimeter of the side wall, at least one of the plurality of ribs being disposed within the channel.

* * * * *